US006145557A

United States Patent [19]

Theurer

[11] Patent Number: 6,145,557

[45] Date of Patent: Nov. 14, 2000

[54] MACHINE FOR TREATING RAIL PADS

[75] Inventor: Josef Theurer, Vienna, Austria

[73] Assignee: Franz Plasser Bahnbaumaschinen-Industriegesellschaft m.b.H, Vienna, Austria

[21] Appl. No.: 09/387,879

[22] Filed: Sep. 1, 1999

[30] Foreign Application Priority Data

Sep. 9, 1998 [AT] Austria ..... 1525 98

[51] Int. Cl.[7] ..... B27C 5/00

[52] U.S. Cl. ..... 144/133.3; 144/2.1; 144/133.1

[58] Field of Search ..... 144/2.1, 4.4, 133.1, 144/133.3, 134.1; 409/226

[56] References Cited

U.S. PATENT DOCUMENTS 1,820,636 8/1931 Talboys ..... 144/133.3

2,754,861 7/1956 Faurel et al. ..... 144/133.3

4,848,426 7/1989 Whitaker, Jr. ..... 144/133.3

*Primary Examiner*—W. Donald Bray

*Attorney, Agent, or Firm*—Henry M. Feiereisen

[57] ABSTRACT

A machine for treating a track composed of two rails fastened to ties and rail pads interposed between the rails and ties has a machine frame supported on the track for mobility in a longitudinal direction. Mounted to the machine frame are two vertically adjustable track lifting units spaced from one another in the longitudinal direction, each being associated with a tie displacement device having a pressing element. The latter is arranged for application to a tie to be displaced with the aid of a drive adjusting the pressing element transversely to the longitudinal direction. A vertically adjustable stripping device positioned between the two track lifting units is provided for removing the rail pads situated on the displaced tie.

8 Claims, 2 Drawing Sheets

MACHINE FOR TREATING RAIL PADS

CROSS-REFERENCES TO RELATED APPLICATIONS

This application claims the priority of Austrian Patent Application, Serial No. A 1525/98, filed Sep. 9, 1998, the subject matter of which is incorporated herein by reference.

BACKGROUND OF THE INVENTION

The present invention relates to a machine for treating a track composed of two rails fastened to ties and rail pads interposed between the rails and ties.

Rail pads serve as a protective layer for absorbing and attenuating the damaging high frequency rail vibrations caused by train traffic and are usually made of rubber or synthetic materials. Installed between the base of the rails and the rail seat, i.e. a tie plate, for example, the rail pads provide cushioning, shock absorption and sound abatement. Due to the influence of severe weather conditions as well as continued abrasion and vibrational impact, rail pads suffer wear and tear and eventually must be replaced. This necessitates exposing the rail seat and removing from it the remains of the old rail pad as completely as possible in order to provide a clean and even surface for installing a new rail pad.

In a related field, a track maintenance machine for adzing ties is known, for example, from U.S. Pat. No. 4,848,426. This kind of machine is typically used in rail relaying operations after one rail of the track has been removed. The so-called adzer includes a cutter head mounted for rotation about a vertical axis by means of a rotation drive, the head being vertically adjustable by pivoting about a horizontal axis with the aid of a drive. The cutter head is supported on a mobile machine frame and in operation is guided across the tie in order to smoothen any irregularities in the tie surface in preparation for the installation of a new rail.

SUMMARY OF THE INVENTION

It is the primary object of this invention to provide a machine of the first-described type with which it is possible with minimal or greatly reduced expense to carry out maintenance operations on the rail pads which are positioned between a rail base and a tie of a laid track.

This and other objects are accomplished according to the invention with a machine for treating a track composed of two rails fastened to ties and rail pads interposed between the rails and ties, comprising a machine frame extending in a longitudinal direction along the track, undercarriages supporting the machine frame for mobility on the track, two track lifting units vertically adjustably mounted on the machine frame between the undercarriages and spaced from one another in the longitudinal direction, two tie displacement devices mounted on the machine frame, each tie displacement device being associated with a respective one of the track lifting units and comprising a pressing element arranged for application to a tie to be displaced and a drive for adjusting the pressing element transversely to the longitudinal direction for displacing the tie, and a vertically adjustable stripping device mounted on the machine frame between the two track lifting units and arranged for removing the rail pads situated on the displaced tie.

With a machine equipped with such a combination of track lifting units and tie displacement devices, it is possible to make the tie pads freely accessible for treatment thereof by simply and quickly displacing the ties laterally while slightly lifting the rails. The only preparatory action required for this operation is a loosening of the rail fastening means. Owing to the fact that only the ties are laterally displaced, the position of the track per se advantageously remains largely unchanged so that, after removal of the old rail pad and placement of a new rail pad on the tie and the subsequent restoration of the tie to its original position, all that remains to be done to reproduce the original track situation is only a minimum of follow-up procedures.

BRIEF DESCRIPTION OF THE DRAWING

The above and other objects, advantages and features of the present invention will become more apparent from the following detailed description of a now preferred embodiment thereof, taken in conjunction with the accompanying, somewhat schematic drawing wherein.

DETAILED DESCRIPTION OF PREFERRED EMBODIMENT

Figure 1:
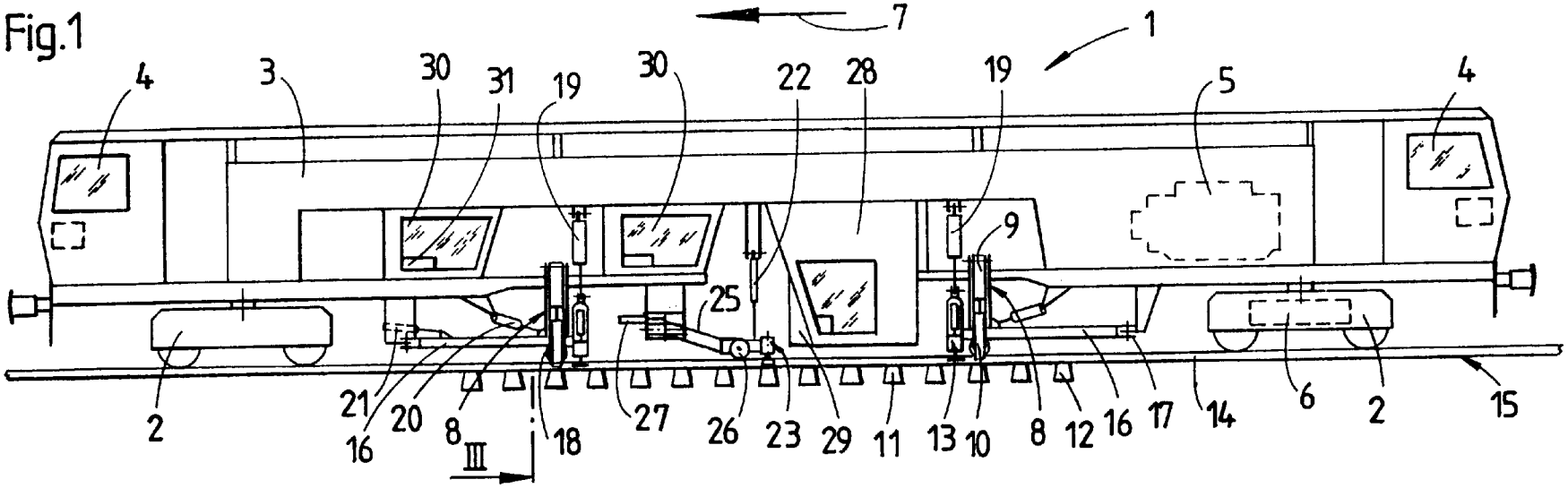
FIG. 1 is a side elevational view of a machine for treating rail pads of a track.

Referring now to the drawing and first to FIG. 1, there is shown a machine 1 having a machine frame 3 extending in a longitudinal direction. Undercarriages 2 are provided for supporting the machine frame 3 on a track 15, composed of two rails 14 fastened to ties 12, for mobility in an operating direction indicated by an arrow 7. The machine 1 is equipped with driver's cabs 4, arranged at both longitudinal ends of the machine frame 3, as well as with a motor 5 and motive drive 6 for propelling the machine along the track 15 during operation.

Arranged between the two undercarriages 2 are tie displacement devices 8 spaced from one another in the longitudinal direction. Each tie displacement device 8 is equipped with a pressing element 10 for application to an end surface 11 of a tie 12, the pressing element 10 being vertically adjustable by means of a drive 9. Further associated with each tie displacement device 8 is a track lifting unit 13 for gripping a rail 14 of the track 15.

Both the tie displacement device 8 and the associated track lifting unit 13 are in each case mounted on a support frame 16 having two ends with regard to the longitudinal direction, one of which ends is connected in a universally movable manner to the machine frame 3 via an articulation 17. The end of the support frame 16 opposite to the articulation 17 is equipped with flanged rollers 18 which rest on the rails 14 of the track 15 during operation of the machine 1. Drives 19 and 20 are provided for vertically and laterally displacing the support frame 16, the drives linking the support frame 16 to the machine frame 3. At least one articulation 17 or support frame 16 is mounted on the machine frame 3 for horizontal displacement in the longitudinal direction by means of a drive 21.

Figure 2:
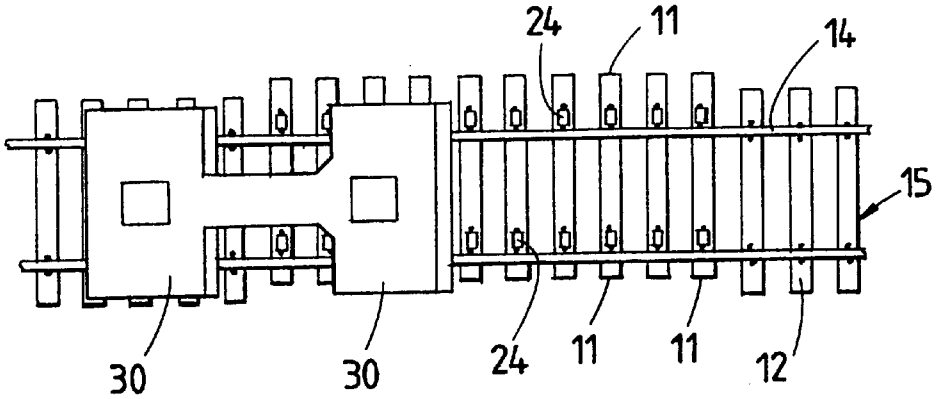
FIG. 2 is a schematic plan view of the track.

Situated between the two tie displacement devices 8 which are spaced from one another in the longitudinal direction is a stripping device 23 for removing tie pads 24, the latter being more clearly visible in FIG. 2. The stripping device 23 is connected to the machine frame 3 for vertical adjustment by means of a drive 22 and is located on a support frame 25 which has flanged rollers 26 in the area of the stripping device 23 for rolling on the track 15. The support frame 25 is mounted to the machine frame 3 for displacement in the longitudinal direction relative thereto by means of a drive 27. An operator's cab 28 is arranged immediately behind the stripping device 23 and is provided with a storage container 29 filled with new rail pads 24. Additional operator's cabs 30 arranged on the machine frame 3 are equipped with respective central control devices 31 and serve to accommodate personnel for observing and controlling the tie displacement device 8 and the stripping device 23.

Figure 3:
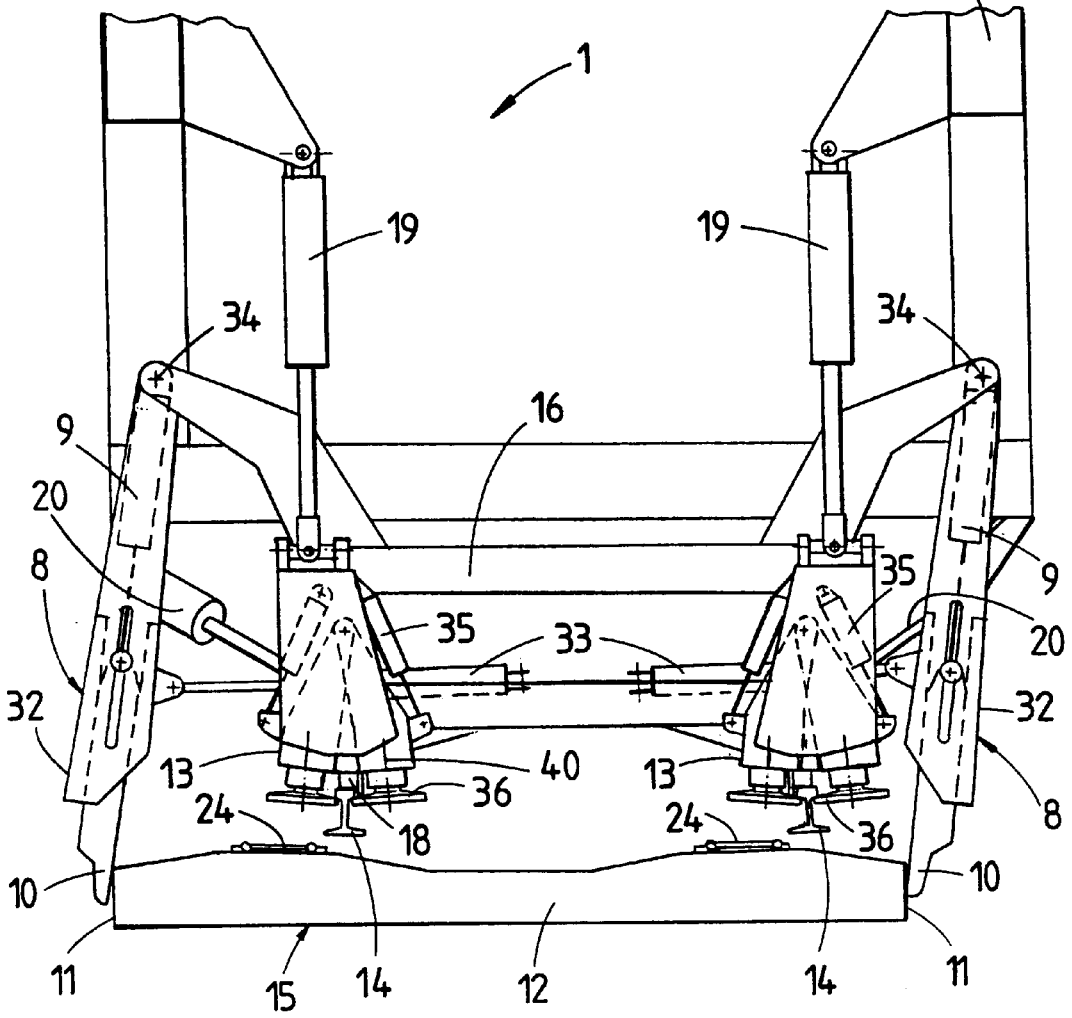
FIG. 3 is a greatly enlarged cross-section of the machine along the section line III in FIG. 1.

Turning now to FIG. 3, it can be seen that each support frame 16 carries two of the track lifting devices 13, spaced from one another transversely of the longitudinal direction, as well as two tie displacement devices 8. A mount 32 is provided in each case to support the pressing element 10, vertically adjustable by means of the drive 9, of the tie displacement device 8. Said mount 32 is fastened to the support frame 16 for pivoting about an axis 34, extending horizontally and in the longitudinal direction, by means of a respective drive 33. The track lifting unit 13 in each case includes of two lifting rollers 36 which are rotatable about an axis 40 and squeezable towards one another with the aid of two squeezing drives 35.

Figure 4:
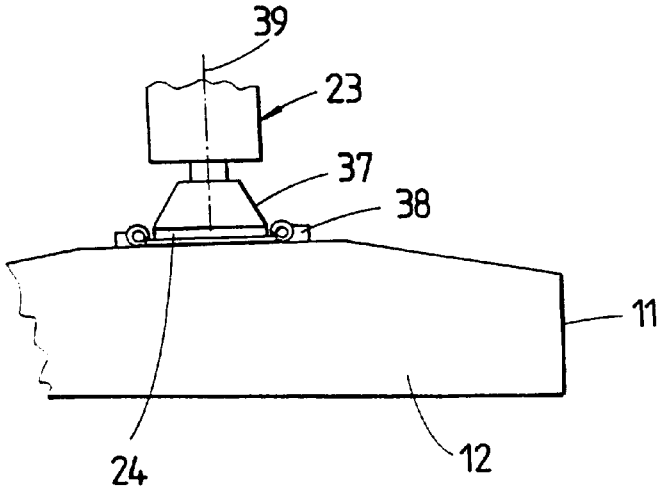
FIG. 4 is an enlarged, detailed view of a tie and a stripping device for removing a rail pad.

As indicated in FIG. 4, the stripping device 23 is formed by a milling cutter 37 which is rotatable about a vertical axis 39. Of course, it would also be possible to provide a shear blade or the like in place of the milling cutter 37. The rail pad 24 to be removed is situated on a tie plate 38 connected to the tie 12.

The mode of operation of the machine I will now be described in more detail.

Immediately prior to the start of working operations by the machine 1, it is necessary to unfasten the rail fastening means (not shown) which connect the rails 14 to the ties 12. Then, the detached rails 14 are raised slightly off the ties 12, located thereunder, by actuation of the drives 19 of the track lifting units 13 of the machine 1. The two pressing elements 10, positioned opposite one another transversely of the longitudinal direction, of the forwardly located tie displacement device 8 are now pressed against the end surfaces 11 of the corresponding tie 12 by actuation of the drives 33, during which it is also possible, if required, to perform a vertical adjustment of the pressing element 10 by means of the drives 9 in order to ensure optimal application of the pressing elements 10 to the end surfaces 11 of the ties 12. While the two drives 20 linking the support frame 16 to the machine frame 3 are blocked, the drives 33 are activated to push the tie 12 to one side (as shown in FIGS. 2 and 3), thus exposing the rail pads 24 which before were situated underneath the rail 14. As soon as the tie 12 has been displaced into the outermost position, the pressing elements 10 are raised with the aid of the drives 9 and the mounts 32 are pivoted back by means of the drives 33. When the mounts 32 have been returned to their starting position, the pressing elements 10 are again lowered and applied to the end surfaces 11 of the next tie 12 which is then also displaced transversely to the longitudinal direction. To facilitate the centering of the pressing elements 10 exactly on the end faces 11 of the ties 12 lying thereunder, the support frame 16 of the forward tie displacement device 8 may be displaced a by a small measure in the longitudinal direction with the aid of drive 21.

For the purpose of removing the damaged rail pad 24, the stripping device 23 is guided across the tie 12 in such a manner that the rotating milling cutter 37 mills the entire rail pad 24 from the tie plate 38. Forward movement of the milling cutter 37 may be accomplished by actuation of the drive 27. Following immediately behind the stripping device 23, an operator situated in the operator's cab 28 retrieves new rail pads 24 from the storage container 29 and places them upon the exposed and stripped tie plates 38. By means of the immediately following second tie displacement device 8, the ties 12 are displaced back into their original position, reversing the above-described displacement procedure.

During the tie displacement operation, the two rails 14 of the track 15 are held unchanged in their original position with regard to the transverse direction of the track by the track lifting units 13. Thus, after returning the ties 12 to their starting position with the aid of the second tie displacement device 8, the rails 14 automatically come to lie on the new rail pads 24 or the ties 12 immediately in front of the rear undercarriage 2. In a separate, subsequent operation, the rails 14 are again properly connected to the ties 12 with the aid of the rail fastening means. In order to facilitate the tie displacement operation, it is useful to plough away the track bed ballast present in the area of the end surfaces 11 of the ties 12, for instance by means of a small ballast plough (not shown).

While the invention has been illustrated and described as embodied in a machine for treating rail pads, it is not intended to be limited to the details shown since various modifications and structural changes may be made without departing in any way from the spirit of the present invention.

What is claimed as new and desired t be protected by Letters Patent is set forth in the appended claims:

1. A machine for treating a track composed of two rails fastened to ties and rail pads interposed between the rails and ties, comprising (a) a machine frame extending in a longitudinal direction along the track;

(b) undercarriages supporting the machine frame for mobility on the track;

(c) two track lifting units vertically adjustably mounted on the machine frame between the undercarriages and spaced from one another in the longitudinal direction;

(d) two tie displacement devices mounted on the machine frame, each tie displacement device being associated with a respective one of the track lifting units and comprising (1) a pressing element arranged for application to a tie to be displaced and (2) a drive for adjusting the pressing element transversely to the longitudinal direction for displacing the tie; and (e) a vertically adjustable stripping device mounted on the machine frame between the two track lifting units and arranged for removing the rail pads situated on the displaced tie.

2. The machine of claim 1, wherein the stripping device is a milling cutter rotatable about a vertical axis.

3. The machine of claim 1, further comprising a support frame, associated with the tie displacement device, and a mount provided to support the pressing element arranged for application to an end surface of the tie, the mount being fastened to the support frame for pivoting about a horizontal axis, extending in the longitudinal direction, by means of the drive for transversely adjusting the pressing element.

4. The machine of claim 3, further comprising a drive for vertically adjusting the pressing element relative to the mount.

5. The machine of claim 3, wherein two track lifting units, spaced from one another transversely of the longitudinal direction, and two tie displacement devices, spaced from one another transversely of the longitudinal direction, are arranged on the support frame.

6. The machine of claim 5, wherein the support frame extends in the longitudinal direction and has two en s, one of the ends comprising the track lifting units and tie displacement devices as well as flanged rollers for support on the track, while the other end is pivotally mounted on the machine frame by means of an articulation.

7. The machine of claim 3, wherein the support frame is mounted on the machine frame for displacement in the longitudinal direction by means of a drive.

8. The machine of claim 3, wherein the support frame is linked, in the region of the tie displacement devices, to the machine frame by means of drives provided between the support frame and the machine frame and articulated to both frames.

* * * * *